US005761154A

United States Patent [19]

Mueller et al.

[11] Patent Number: 5,761,154

[45] Date of Patent: Jun. 2, 1998

[54] ACOUSTIC EXPLODER

[75] Inventors: William J. Mueller; Charles R. Walsh, both of Portsmouth; Adam Jilling, Newport, all of R.I.

[73] Assignee: The United States of America as represented by the Secretary of the Navy, Washington, D.C.

[21] Appl. No.: 854,810

[22] Filed: Aug. 26, 1969

[51] Int. Cl.[6] ..... G01S 15/00

[52] U.S. Cl. ..... 367/96

[58] Field of Search ..... 340/3; 102/18, 102/70.2, 427; 114/20, 23.3, 20.1; 343/7 PF, 17, 2; 367/95, 96

[56] References Cited

U.S. PATENT DOCUMENTS

| | | | |
|---|---|---|---|
| 2,908,888 | 10/1959 | Kirkland | 367/95 |
| 2,943,570 | 7/1960 | Puechberty | 367/96 |
| 3,017,832 | 1/1962 | MacDonald . | |
| 3,031,644 | 4/1962 | Hisserich et al. | 367/96 |
| 3,115,833 | 12/1963 | Hall et al. | 367/96 |
| 3,360,769 | 12/1967 | Lord . | |

OTHER PUBLICATIONS

Cited by applicant on a paper dated: Aug. 1969.

*Primary Examiner*—Daniel T. Pihulic
*Attorney, Agent, or Firm*—Michael J. McGowan; William F. Eipert; Prithvi C. Lall

[57] ABSTRACT

There is disclosed an exploder for an underwater weapon which periodically radiates an acoustic signal and activates the weapon only when the echo signal has the same phase as the radiated signal. Thus, echoes from any air-water interface are disregarded.

6 Claims, 3 Drawing Sheets

ACOUSTIC EXPLODER

The invention described herein may be manufactured and used by or for the Government of the United States of America for governmental purposes without the payment of any royalties thereon or therefor.

The present invention relates generally to acoustic detecting arrangements for underwater weapons and, more particularly, to a method of and apparatus for discriminating between target vessels and other acoustic signal reflecting means.

Present day underwater weapons systems utilize a wide variety of detecting arrangements for locating the target and triggering the explosive payload. The influence exploder used in some torpedoes against surface vessels must distinguish between these vessels and the ocean surface. When large surface waves are present, this discrimination becomes difficult and sometimes results in improper discharge of the weapon. Conventional acoustic exploders may misfire because of echo returns from the ocean surface, from the wake left by the target, or any other discontinuity in the operating area. Magnetic detectors, likewise, must be calibrated for different magnetic backgrounds and target size.

It is accordingly a primary object of the present invention to provide an acoustic detector for underwater weapons which is capable of recognizing echoes from the metal-water interface of a target and echoes from the air-water interface of a wake or sea surface.

Another object of the present invention is to provide an acoustic detector for an underwater weapon system which employs a phase comparison operation to discriminate proper target echoes from spurious echoes produced by a wake, a wave or a boundary layer discontinuity.

Another object of the present invention is to provide an acoustic detector for a torpedo which will activate the torpedo explosive payload only when there is a predetermined phase relationship between the transmitted acoustic signal and its echo.

Briefly and in somewhat general terms, the above objects of invention are accomplished by taking advantage of the fact that acoustic echoes from air-water interfaces can be differentiated from acoustic echoes from metal-water interfaces by the phase reversal that takes place at the former. In contrast, an acoustic signal impinging on a metal-water interface is reflected without a phase reversal. This phenomenon is employed in the present invention to determine whether or not the acoustic echo is from a valid target. The simplest way of accomplishing this is by comparing the transmitted acoustic signal with each received echo. If these signals have the same phase, a proper target is present and the torpedo may then be exploded when it comes within lethal range. By gating the receiver so as to have it respond to echoes from this range only, the acoustic detector can perform the additional function of triggering the explosive at a stand-off distance calculated to achieve greatest target destruction.

The problem of determining whether or not the radiated acoustic signal experiences a phase reversal at the reflecting boundary may be solved in a wide variety of ways, depending upon the characteristics of the transmitted signal. For example, if the signal is sent out as a coded pulse train, a matching filter may be employed to perform the comparison operation. If the transmitted signal is only a single pulse of a predetermined polarity, the receiver need only include an appropriate rectifying network for passing this pulse and blocking all others of different polarity. If the transmitted signal is a full cycle of a particular frequency, then the negative or positive slope corresponding to the transition between peaks of the signal can be ascertained. Circuits for recognizing this difference in slope are available in the prior art. One circuit disclosed in U.S. Pat. No. 2,864,077 of Dec. 9, 1958, works by separating the two half cycles of each full wave and then subjecting these half cycles to a differentiating operation and combining the results thereof. One slope form yields a negative spike while the other will generate a positive spike, and these spikes are readily distinguished in an appropriate circuit. Likewise, if the transmitted signal is a properly chosen complex function, a phase reversal may be determined by processing the echo over an appropriate time period and examining the results thereof.

Other objects, advantages and novel features of the invention will become apparent from the following detailed description of the invention when considered in conjunction with the accompanying drawings wherein.

Figure 1:
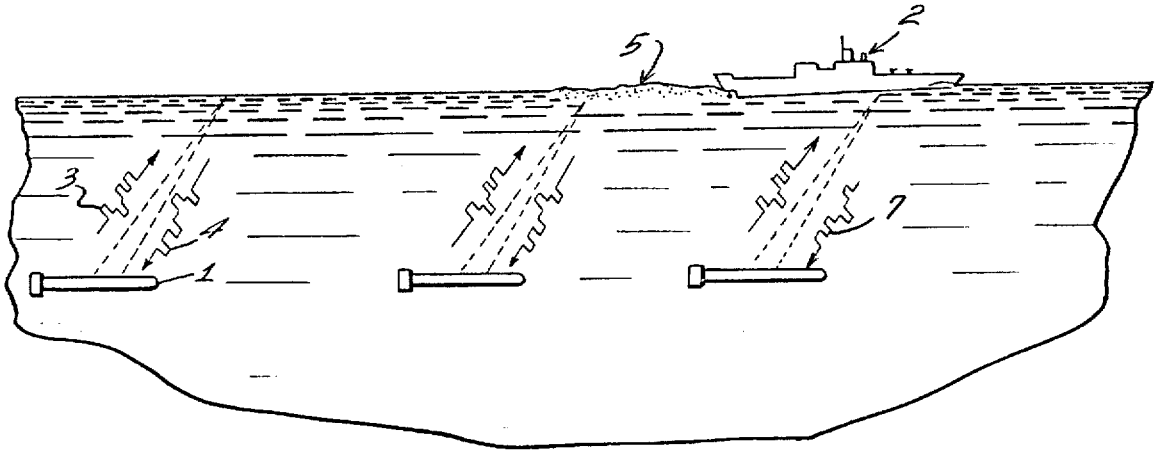
FIG. 1 illustrates the operating principle of the present invention as the underwater weapon approaches a surface target.

Referring now to FIG. 1 of the drawings, which illustrates the manner in which the present invention operates to detonate a torpedo 1 fired or otherwise launched to approach a surface target 2 from the rear at a depth below its wake, this torpedo periodically radiates a coded acoustic pulse train 3 which, in the example selected, consists of a pair of positive pulses followed by a negative pulse and a third positive pulse. The acoustic signal is radiated in a narrow beam in a direction slightly advanced of the vertical and, consequently, when it reaches the ocean surface, a portion thereof, as is well known, is reflected from the interface back towards the torpedo where it is detected. Because of the nature of the impedance discontinuity at the air-water interface, the acoustic signal experiences a phase reversal and returns to the torpedo as pulse train 4. This signal, unlike the radiated signal, contains a pair of negative pulses followed by a single positive pulse and a third negative pulse. This phase reversal is recognized by the detector, and this echo signal and all subsequent echo signals from the ocean surface are disregarded.

As the torpedo proceeds to overtake the target, it reaches the vicinity of the vessel's wake 5. This wake, as is well known, also behaves as a sound energy reflecting means and echo pulses are received from this sea condition. These echo pulses also are of an inverted phase because of the composition of the wake.

Finally, as the torpedo approaches the immediate vicinity of target 2, the acoustic signals strike the ship's hull and, because of the nature of the acoustic impedance mismatch, the signals are now reflected for the first time without a phase reversal, as shown in pulse train 7. The detector of the present invention recognizes this phase condition and detonates the explosive payload at an appropriate time.

Thus, the actuator or the control device carried by the weapon responds to sound wave energy signals reflected from objects or material in the propagation path whose acoustic impedance is higher than that of water. It does not respond to any acoustic signals reflected from the surface of the ocean, the wake of a vessel or it's own wake, which it may encounter in certain search modes, or any other objects which have a lower acoustic impedance than the water.

Figure 2:
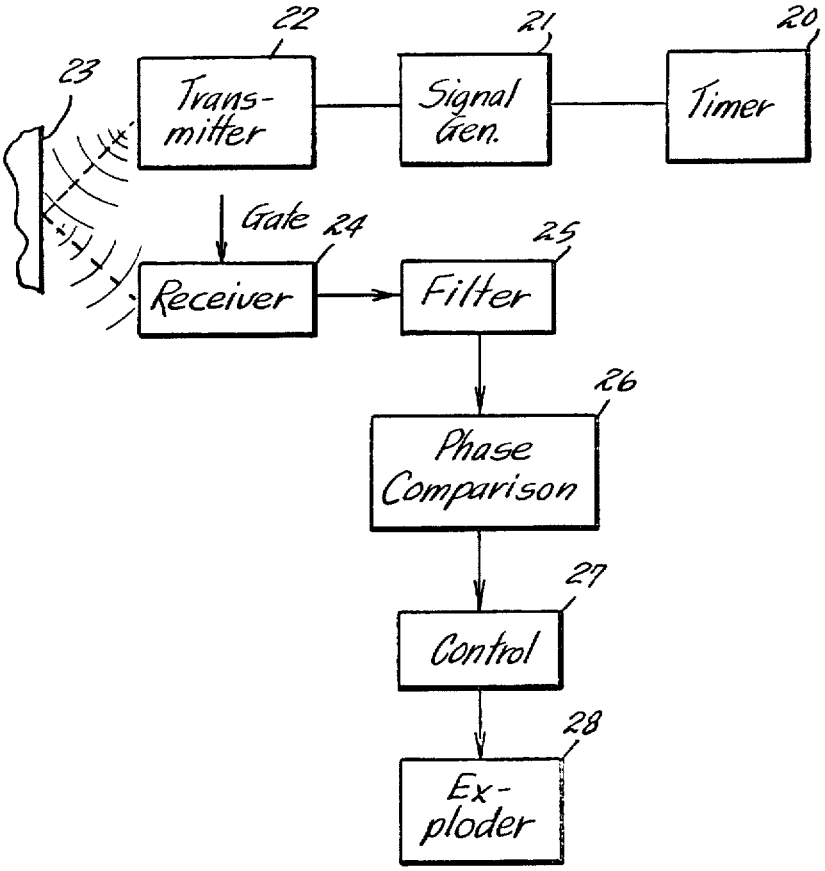
FIG. 2 is a block diagram showing the general composition of a system utilizing the present invention.

FIG. 2 illustrates the components of a basic system according to one form of the present invention. Here, a timer 20 periodically activates a signal generator 21 causing transmitter 22, mounted in the underwater weapon, to radiate a directional acoustic signal having a preselected wave form which, as noted hereinbefore, may be anything from a single pulse, a single full cycle of a predetermined frequency, a plurality of such cycles, a coded pulse train or a nonsymmetrical wave form having unequal amplitude positive and negative portions. The acoustic signal, as is well known, propagates through the fluid medium until it impinges upon a reflecting means 23. The echo signal returning therefrom is subsequently detected by receiver 24 and fed to a band-pass filter 25. Thereafter, it is processed in a phase comparison circuit 26 whose output selectively operates the control device 27 which arms or discharges the explosive payload carried by the weapon.

If signal generator 21 produces a single pulse of a predetermined polarity, then the problem of detecting a phase reversal or an in-phase condition at the receiver is relatively simple. For example, the output of receiver 24 need only be fed to a rectifier circuit adapted to pass only positive pulses. This rectifier, consequently, would recognize an inverted pulse and prevent it from passing further along the system to the firing circuit.

Figure 3:
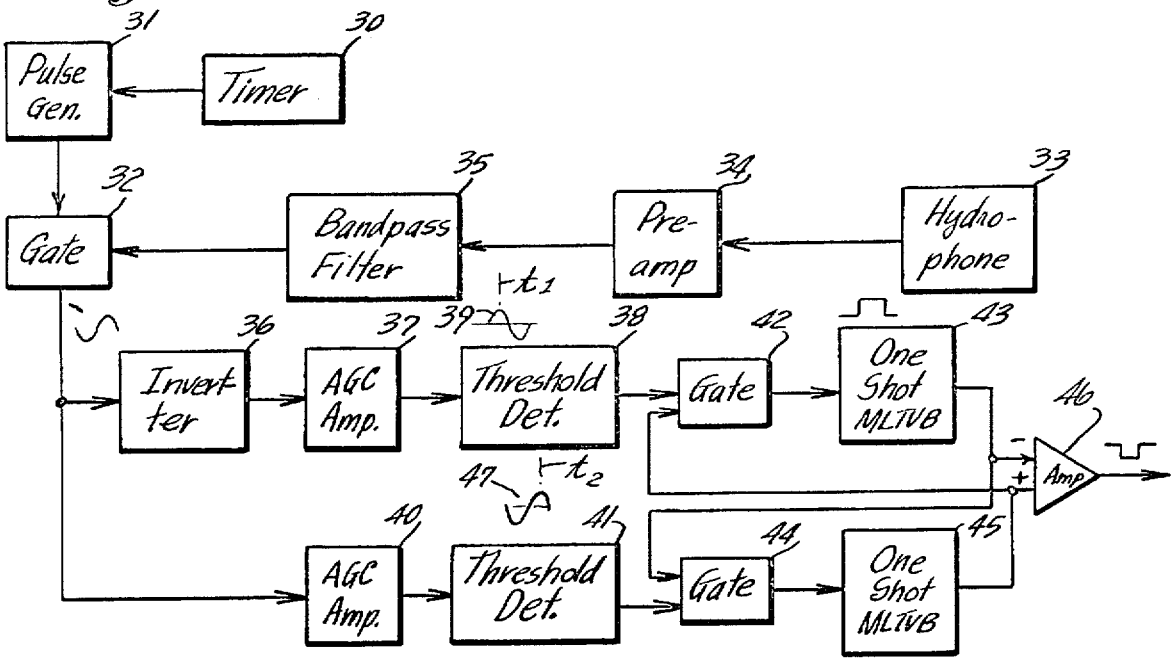
FIG. 3 illustrates a system for ascertaining whether or not the received echo signal has experienced a phase reversal.

FIG. 3 illustrates a system which may be utilized to determine whether or not the first half cycle of the echo signal is in phase or out of phase with the corresponding half cycle of the radiated acoustic signal. In this arrangement, timer 30 periodically activates a pulse generator 31 so as to open a gate 32 for a preselected time interval, thereby permitting echo signals detected by hydrophone 33 from a predetermined range, after their amplification and filtering in circuits 34 and 35, to pass into the phase determining portion of the system. It would be appreciated that timer 30, pulse generator 31 and gate 32 act as a gate receiver. One output of gate 32 is fed to an inverter 36 which reverses the phase of the detected signal. Thereafter, this signal passes to an automatic gain control amplifier 37 and to a threshold detector 38 which is set, for example, to pass only positive pulses whose amplitude exceed a predetermined level, such as the top portion of the first half cycle of the sinusoidal wave form shown at 39. Another output of gate 32 is fed directly to a second automatic gain control amplifier 40 and a similar threshold detector 41 operating in the same manner.

The output of detector 38 is fed to a gate 42 and a one-shot multivibrator 43. Likewise, the output of detector 41 is fed to a gate 44 and a one-shot multivibrator 45. The output of multivibrator 43 is fed across to the input of gate 44 as a blocking pulse, while the output of multivibrator 45 is similarly fed back to gate 42 for the same purpose. It will be appreciated that whichever multivibrator operates first blocks the gate in the other signal path and thereby prevents the other multivibrator from being operative for the duration of the multivibrator pulse. The output of multivibrator 43 is supplied to an operational amplifier 46 at a terminal which results in a negative pulse appearing in its output circuit, whereas the output of multivibrator 45 is connected to another terminal of this amplifier which results in a positive pulse appearing in this output circuit.

The operation of the system of FIG. 3 is as follows: In the case where the input signal commences with a negative first half cycle, this signal, as a result of the phase inversion from circuit 36, appears at detector 38 with a first positive half cycle, as shown in wave form 39. Simultaneously, the input signal also appears at threshold detector 41 with its original form, as shown by wave form 47. Consequently, threshold detector 38 produces an output signal before threshold detector 41. The signal so produced passes through gate 42 and triggers multivibrator 43 which generates an output pulse that immediately blocks gate 44 and prevents the subsequent output signal from detector 41 from passing through this gate and reaching multivibrator 45. Consequently, when the input signal to the system starts with a negative half cycle, a negative pulse is produced in the output of amplifier 46. Likewise, if the input signal starts with a positive half cycle, the reverse operation takes place and a positive pulse appears in the output of this amplifier.

Each multivibrator, it will be appreciated, produces a pulse whose duration exceeds that of the radiated acoustic signal. Both multivibrators are also restored to their standby state in time to respond to subsequent echo signals detected by hydrophone 33.

Since the nature of the radiated signal is known, that is, since the signal generator coupled to the transducer is controlled or gated, for example, to always commence with a positive or negative half cycle, an appropriate rectifier, threshold detector or polarity responsive device may be connected in the output circuit of amplifier 46 to pass only those pulses, either positive or negative, which correspond to a valid target to the firing mechanism. In other words, if the acoustic signal starts with a negative half cycle, the device connected in the output of amplifier 46 should operate to pass only negative pulses and block all others.

In any situation, the firing circuit may be designed so as to respond to a predetermined number of valid echo signals. For example, each output pulse above produced may be fed to a counter or employed to step charge a storage capacitor. When either a predetermined count is reached or the capacitor attains a predetermined voltage level related to a preselected number of echo signals, the firing circuit of the weapon is activated.

Figure 4:
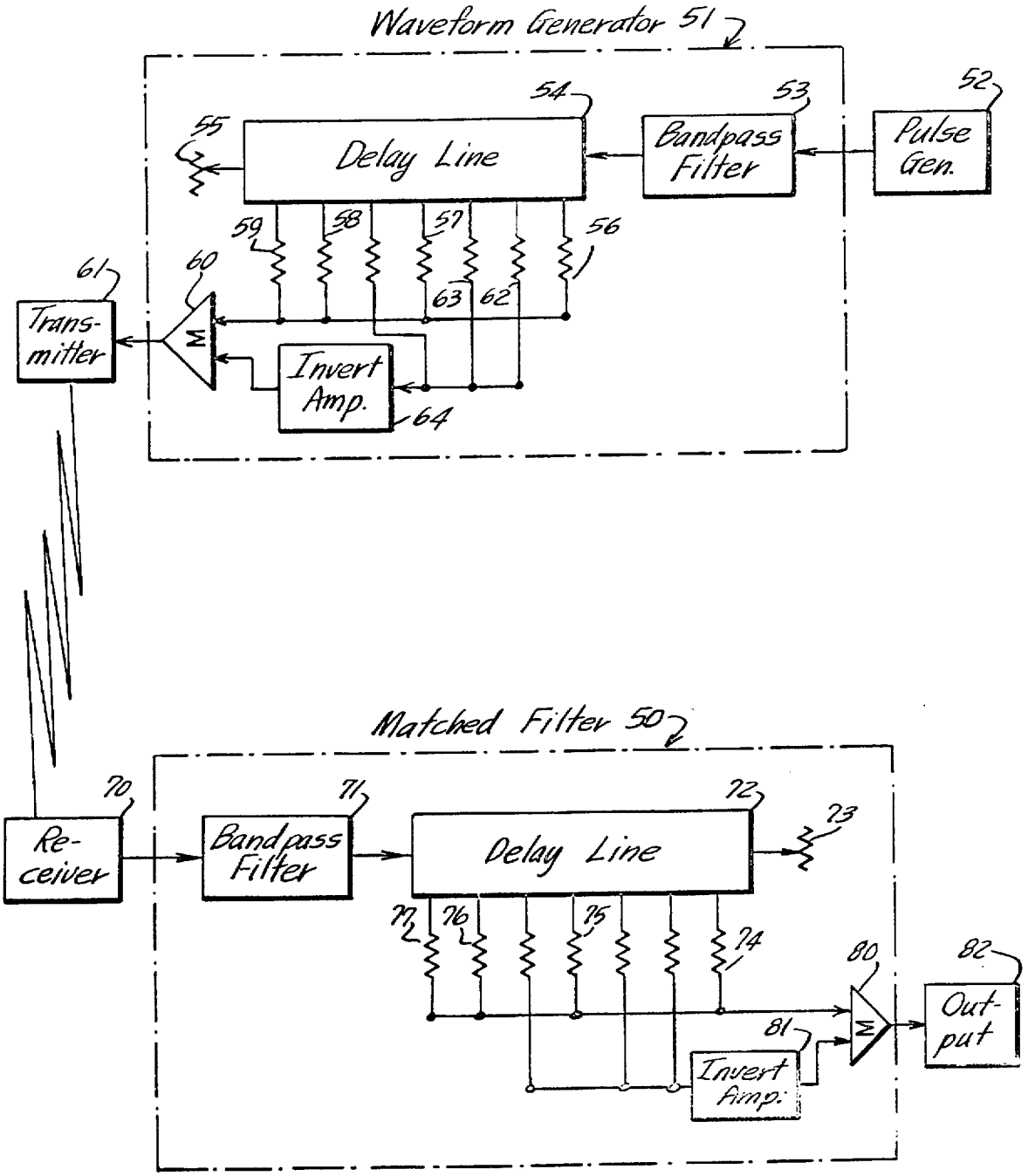
FIG. 4 is an embodiment of the invention wherein a matched filter is used in the transmitter and receiver portion of the system.

In FIG. 4, there is shown a modification of the present invention wherein a matched filter 50 is employed in the receiver to determine whether or not the radiated acoustic pulse train produced by wave form generator 51 has experienced a phase reversal. By utilizing a matched filter, the complete radiated signal is, in effect, stored in the receiver in a manner which permits a direct comparison with an echo signal whenever this signal appears back at the weapon.

In this system, pulse generator 52 is coupled to a band-pass filter 53, and the output of this filter is fed to one end of a delay line 54 terminated in its characteristic impedance 55. By tapping this delay line at appropriately spaced points, such as 56, 57, 58 and 59, a pulse train made up of equivalently spaced positive pulses may be produced. This pulse train is coupled to a summation circuit 60 and thereafter radiated by transmitter 61. To include complementary negative pulses in the pulse train, the remaining taps on the delay line, such as 62 and 63, for example, are employed and connected to an inverter 64 whose output also goes to the summation amplifier 60. This method of generating a coded pulse train is well known in the prior art and has been used, for example, in the radar art where jamming and other disturbances are encountered.

In the receiving portion of the system, the echo signals are detected at 70, then fed to a band-pass filter 71 and to a delay line 72, similar to delay line 54, and terminating in its characteristic impedance 73. Delay line 72 has taps at the same locations as delay line 54; for example, connections 74, 75, 76 and 77 correspond to connections 56, 57, 58 and 59. Thus, when the incoming coded signal corresponds to the transmitted signal, pulses will be available at all of the various taps of delay line 72, and the output from the summation circuit 80 will be a signal of maximum amplitude with, for example, a positive polarity. To the extent that the received pulse train differs from the radiated pulse train, this output will diminish. However, if the received pulse train is a phase inverted replica of the radiated pulse train, the summation circuit will again yield a signal of maximum amplitude but, this time, the signal will have a reverse sign. Consequently, an appropriate polarity detector need only be utilized in the output circuit to determine whether or not the received signal has the proper phase of a valid target signal. Any circuit which responds to a positive voltage above a predetermined threshold level may suffice for this purpose.

As mentioned hereinbefore, a conventional matched filter when used in the receiver will produce an output which will change only in sign when the transmitted signal suffers a phase reversal. Thus, it is only necessary to measure the polarity of the largest peak in the output of the matched filter to determine whether the radiated signal as received is phase inverted by 180° or of unchanged phase. To assure the reliability of the detector in multipath interference conditions, which conditions will generally be caused by reflection from multiple surface elements, such as a disturbed sea surface, bubbles and other mechanisms, it is desirable that the autocorrelation function of the signal contain low correlation side lobes. This condition will assure that individual multipaths will be resolved without polarity ambiguity due to side lobe summation. It requires that the radiated signal contain a large percentage bandwidth. A further advantage of a broad band signal is the very low polarity ambiguity that such a signal has. Furthermore, inherent scatterers, such as bubbles, will not reflect a broad band signal very strongly so that masking of the target hull return by a return from bubbles under the hull is more difficult.

Figure 5:
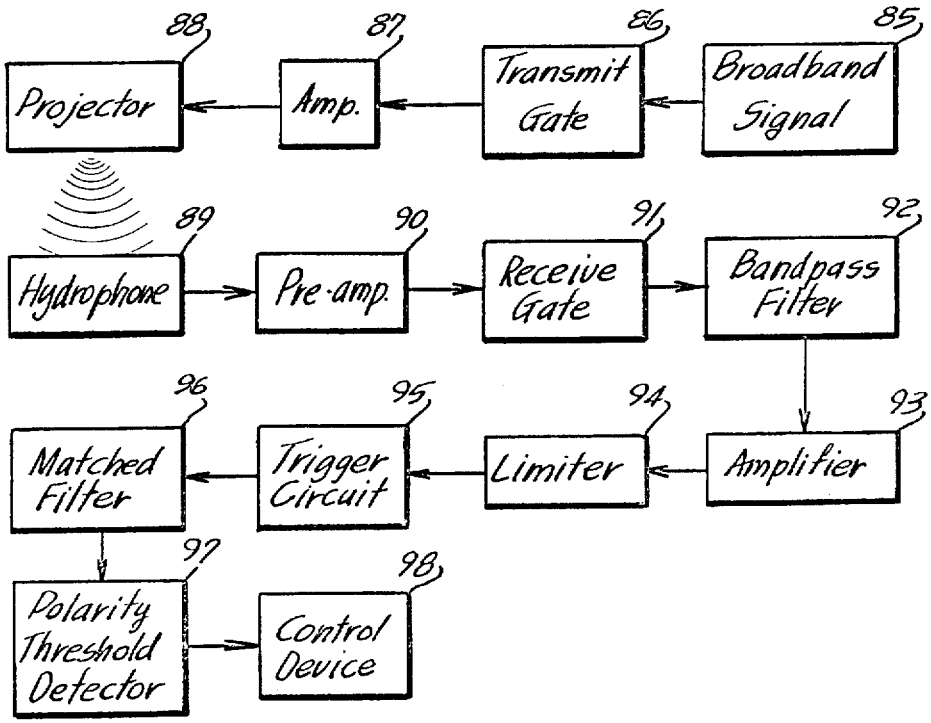
FIG. 5 is a box diagram of an over-all system employing a matched filter in the receiving apparatus.

FIG. 5 illustrates a system where a broad band signal source 85 is connected to a transmit gate 86 which periodically couples this source to an amplifier 87 and projector 80. The echo signal is detected by hydrophone 89 and thereafter preamplified in circuit 90 and sent through a receiving gate 91 to a band-pass filter 92. From this filter, the signal passes to an amplifier 93, a limiter 94 and a trigger circuit 95, the last two circuits serving to shape the signal to an appropriate wave form prior to its application to matched filter 96. The output of this matched filter, as mentioned hereinbefore, is sensed by a polarity threshold detector 98 so that when, for example, the output of filter 96 exceeds a positive threshold level by a predetermined amount, control device 98 coupled thereto is activated.

The broad band signal for such a system may be a properly chosen binary code having low correlation side lobes. Since a matched filter is used for detection and since different codes may be selected, the system will perform with higher ambient noise levels and be more resistent to jamming than when a single pulse is radiated and detected. The matched filter in the above system may be a bank of digital shift registers whose outputs are tapped by resistances which are fed into either junction of a summing operational amplifier.

It would be mentioned that the acoustic signal may be produced by a mechanical device or any electrical arrangement that is satisfactory. If the acoustic signal is nonsymmetrical about a zero amplitude level but symmetrical energywise, then the signal processing circuit must include a dipping operation prior to the integration operation. To produce a single pulse, a mechanical or electromechanical arrangement may be preferable. Also, the transmitting and receiving elements of FIG. 2 or the projector or hydrophone of FIG. 5 may be a unitary device, such as a piezoelectric crystal array.

What is claimed is:

1. Apparatus for selectively detonating an explosive charge carried by an underwater weapon which is operating within the ocean comprising, in combination, means for periodically radiating from said weapon an acoustic signal having a predetermined wave form, said signal being radiated such that a portion thereof travels to the ocean surface and is reflected therefrom with a phase reversal;

means for detecting any echo signals arriving at said weapon from any reflecting means located in the propagation path of said radiated acoustic signal and from said ocean surface; and means responsive to the detection of a predetermined number of only those echo signals which do not have a phase reversal for detonating said explosive charge whereby the apparatus discriminates against those signals which are reflected from the ocean surface.

2. Apparatus for selectively detonating an explosive charge carried by a weapon operating within a fluid medium comprising, in combination, means for periodically radiating from said weapon an acoustic signal having a predetermined wave form;

means for detecting any echo signals arriving at said weapon from reflecting means located in the propagation path of said radiated acoustic signal; and means responsive to the detection of a predetermined number of only those echo signals which are reflected from said reflecting means without a phase inversion for detonating said explosive charge.

3. Apparatus for detonating an explosive charge carried by a weapon operating within a fluid medium comprising, in combination, means for periodically radiating from said weapon an acoustic signal having a preselected wave form;

means for detecting echo signals arriving at said weapon from reflecting means located in the propagation path of said radiated acoustic signal; and means for detonating said explosive charge whenever a predetermined number of echo signals have been detected at said weapon which have a wave form the same as the corresponding radiated acoustic signal, whereby said detonation occurs only when said reflecting means has an acoustic impedance greater than that of said fluid medium.

4. In an arrangement as defined in claim 2, wherein said radiated acoustic signal is in the form of a coded pulse train; and wherein said means for detonating said explosive charge includes a matched filter.

5. In an arrangement as defined in claim 2 wherein said acoustic signal is in the form of a sinusoidal signal and wherein said means for detonating said explosive charge includes:

means for producing a phase inverted counterpart of each detected echo signal; and means for generating a control pulse for detonating said explosive charge only when the amplitude of the echo signal first attains a predetermined reference level during the first complete cycle thereof before its phase inverted counterpart does.

6. In a system for selectively detonating the explosive payload carried by an underwater weapon, means at said weapon for periodically radiating an acoustic signal of a preselected wave form and for detecting any echo signals returning from reflecting means located in the propagation path of said radiated acoustic signal; means for comparing each echo signal so detected with the corresponding radiated acoustic signal to determine whether the echo signal has experienced a phase reversal at the reflecting means; and means for detonating said explosive payload only when the echo signal has not experienced such a phase reversal, whereby detonation of the explosive payload occurs only when reflecting means has an acoustic impedance greater than that of seawater.

* * * * *